US006332787B1

(12) United States Patent
Barlow et al.

(10) Patent No.: US 6,332,787 B1
(45) **Date of Patent: *Dec. 25, 2001**

(54) WET-MATEABLE ELECTRO-OPTICAL CONNECTOR

(75) Inventors: Stewart M. Barlow; James L. Cairns, both of Ormond Beach, FL (US)

(73) Assignee: Ocean Design, Inc., Ormond Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/641,313

(22) Filed: Aug. 18, 2000

(51) Int. Cl.[7] ..... H01R 13/44

(52) U.S. Cl. ..... 439/138; 439/201; 439/271; 439/310

(58) Field of Search ..... 439/138, 201, 439/310, 271

(56) References Cited

U.S. PATENT DOCUMENTS

| | | | |
|---|---|---|---|
| 5,203,805 | 4/1993 | Cairns | 439/199 |
| 5,645,442 | 7/1997 | Cairns | 439/201 |
| 6,017,227 | 1/2000 | Cairns et al. | 439/138 |

*Primary Examiner*—Paula Bradley
*Assistant Examiner*—Ann McCamey
(74) *Attorney, Agent, or Firm*—Brown, Martin, Haller & McClain, LLP

(57) ABSTRACT

An electro-optical connector has a plug unit and a receptacle unit which are releasably mateable in an underwater environment. Each unit has at least two separate contact chambers extending inwardly from the front end, one for containing optical contacts and the other for containing electrical contacts. Each optical contact chamber is sealed by a rolling seal member rotatably mounted in a recessed seat in a front end wall of the chamber for rotation in a non-axial direction between a closed position in which a seal through bore is offset from an inlet into the chamber and an open position in which the seal through bore is aligned with the inlet. One electrical chamber contains an electrical socket and has a front end wall having a sealable opening, an annular seal member mounted in the sealable opening, and a resiliently biased stopper movably disposed in sealing engagement within the annular seal member when the units are not mated. The other electrical chamber contains a conductive probe adapted for insertion through the sealable opening in the first electrical contact chamber to sealably engage the annular seal member and move into electrical contact with the socket. Thus, the electrical sealing arrangement is completely separate and different from the optical sealing arrangement.

17 Claims, 5 Drawing Sheets

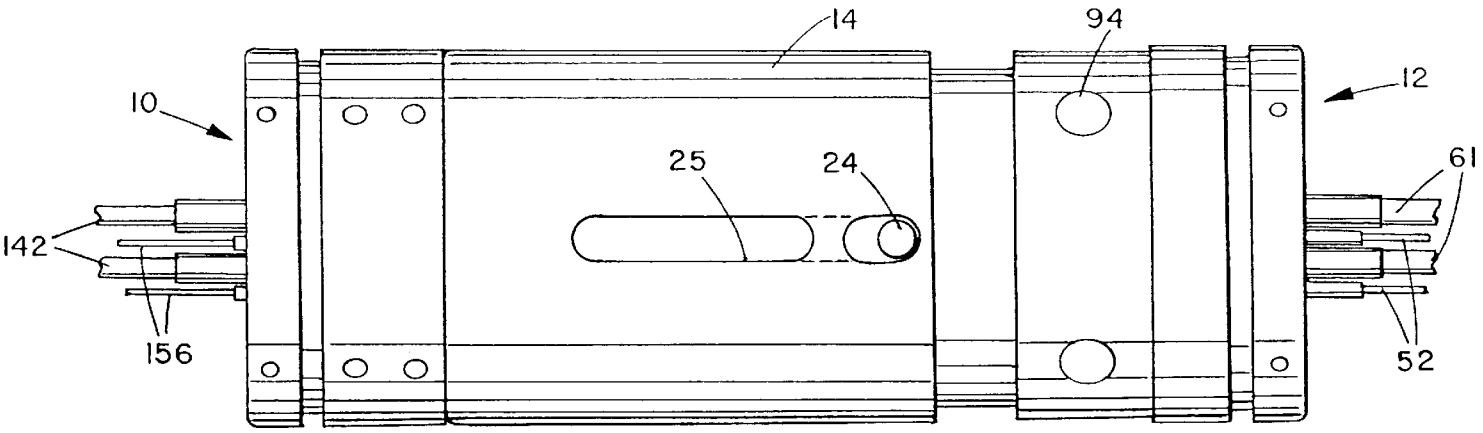
FIG. 1
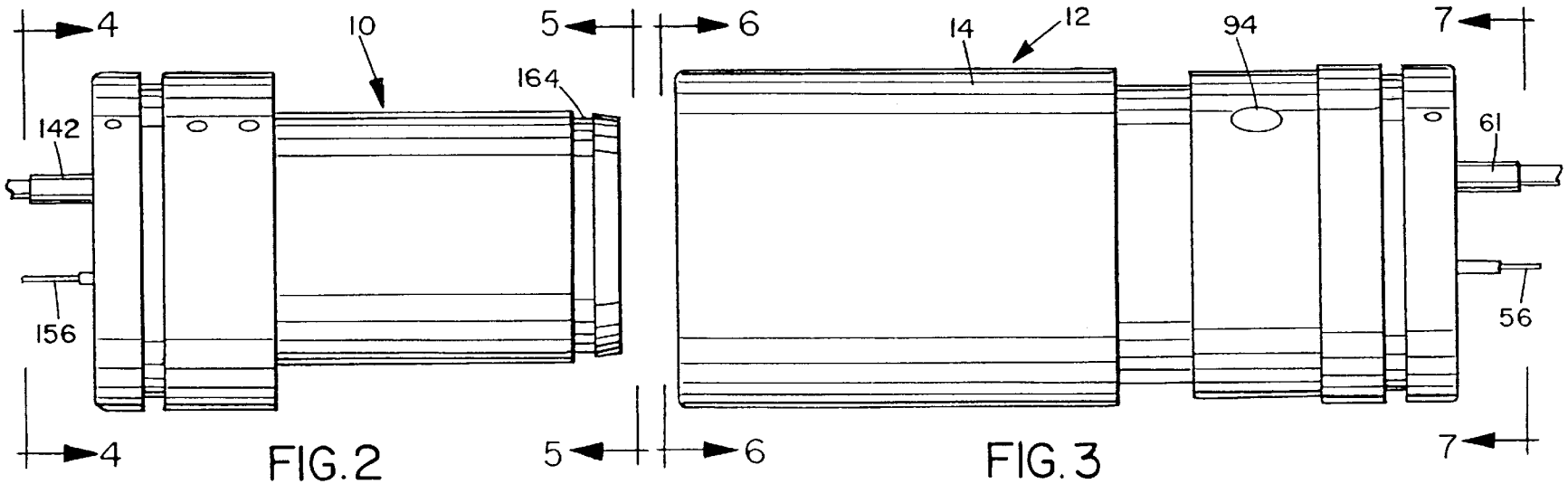
FIG. 3
FIG. 2

WET-MATEABLE ELECTRO-OPTICAL CONNECTOR

BACKGROUND OF THE INVENTION

The present invention relates to a pin and socket type, wet-mateable connector for making electrical and fiber-optic cable connections in a harsh environment, such as an underwater or deep sea environment, a splash zone, or other harsh or hazardous environment. .

Both electrical and optical cables are now commonly used in undersea environments for various applications, such as telecommunications, oceanography, submarine systems, and subsea oil and gas development. There are many problems inherent in successfully mating electrical and optical circuits or cables underwater, particularly in ensuring adequate, reliable sealing and protection of the optical contact faces at deep sea depths.

Current underwater connectors typically comprise releasably mateable plug and receptacle units, each containing one or more electrical or optical contacts or junctions for engagement with the junctions in the other unit when the two units are mated together. The contacts on one side are in the form of pins or probes, while the contacts or junctions on the other side are in the form of sockets for receiving the probes. Typically, the socket contacts are contained in a sealed chamber containing dielectric fluid, and the probes enter the chamber via one or more sealed openings. One major problem in designing such units is the provision of seals which will adequately exclude seawater from the contact chamber after repeated mating and demating.

In some known underwater electrical connectors, such as the connector described in U.S. Pat. No. 5,645,442 of Cairns, the receptacle unit has a stopper which is positioned in sealing engagement with an annular end seal when the units are not mated. The chamber sealed by the stopper and end seal contains a circuit contact and dielectric fluid. As the plug probe enters the chamber, it pushes the stopper back, enters the inner chamber, and makes electrical contact with the circuit connection. At the same time, the end seal will seal against the plug probe to ensure that water cannot enter the chamber. This provides a robust and reliable electrical connector for use in harsh, deep sea environments, but it cannot accommodate optical circuits U.S. Pat. No. 6,017,227 of Cairns et al. describes a hybrid, wet-mateable electro-optical connector which has oil-filled and pressure-balanced plug and receptacle units, together with a rolling seal arrangement for sealing the oil-filled chamber of each unit when unmated. Within the internal oil chambers of both units, groups of contact junctions are aligned behind cylindrical seals which are mounted in seats in the front face of each unit. As the units are mated together, projecting portions of the cylindrical seals engage and press against each other, forcing water out from between them. As the mating sequence continues, actuators engage the two rolling seals to rotate them in unison, transporting any trapped debris to one side, and at the same time aligning openings in the seals with the oil-filled chambers. Probes in one unit then extend through the aligned seal openings into the chamber in the other unit, contacting sockets within the receptacle. This connector may be used for optical or electrical circuits, or both optical and electrical circuits. It ensures that none of the contacts are ever exposed to the outside environment, whether before, during, or after mating.

Although the rolling seal connector provides an extremely reliable sealing mechanism which can withstand repeated mating and de-mating, it cannot accommodate larger electrical circuits of relatively high voltage. Thus, its capacity for providing an electro-optical junction is limited.

SUMMARY OF THE INVENTION

It is an object of the present invention to provide a new and improved wet-mateable electro-optical connector particularly suitable for underwater use.

According to the present invention, an electro-optical connector is provided, which comprises a receptacle unit and a plug unit releasably securable to the receptacle unit in a mated condition of the units, the units each having a rear end, a front end, and at least two chambers extending side-by-side inwardly from the front end, one of the chambers comprising an optical contact chamber and the other chamber comprising an electrical contact chamber, at least one optical contact element mounted in the optical contact chamber and at least one electrical contact element mounted in the electrical contact chamber, each of the optical contact chambers having a front end wall having a recessed seat communicating with the respective first chamber, and a seal member movably mounted in the seat, the seal member having at least one through bore and being movable in a non-axial direction relative to the respective unit between a first, closed position in which the through bore is offset from the chamber and the end of the chamber is sealed, and a second, open position in which the seal through bore is aligned with the chamber, the optical contact element in the optical contact chamber of the plug unit extending through the aligned through bores into the optical contact chamber of the receptacle unit when the units are mated together and the seal members are in the open position to contact the optical contact element in the optical contact chamber of the receptacle unit, one of the electrical contact chambers having a front end wall having a sealable opening, an annular seal member mounted in the sealable opening, and a resiliently biased stopper movably disposed within the annular seal member and in sealing engagement with the annular seal member when the units are not mated, and the electrical contact element in the other electrical contact chamber comprising a conductive probe adapted for insertion through the sealable opening in the first electrical contact chamber to sealably engage the annular seal member and engage the electrical contact element when the units are mated together.

In one embodiment, the seal members of the optical contact chambers are cylindrical, rolling seals, each rotatably mounted in a cylindrical or part-cylindrical seat in a front end wall of the respective chamber, for rotation about the longitudinal axis of the cylindrical seal.

In one embodiment of the invention, the plug unit has an electrical contact chamber having the annular seal member at its forward end sealed by the resiliently biased stopper, while the receptacle unit has an electrical contact chamber containing the conductive probe. As the conductive probe engages the forward end of the opposing second chamber of the plug unit, it pushes the stopper rearwardly into the chamber and moves into electrical contact with the electrical contact member in the chamber, with the body of the probe replacing the stopper in the end opening to seal the opening against leakage or seeping of fluid past the seal.

In this invention, the optical contacts are located in chambers separate from the electrical contacts, with the optical chambers each sealed by rolling seal members, while the electrical contact chamber has a simpler seal arrangement. The electrical circuit connector arrangement has the capability of accommodating larger electrical circuits with more sets of contacts than would be possible with a rolling seal connector for the electrical side. At the same time, the reliable rolling seal connector arrangement is maintained for the optical circuits. Thus, this invention combines a high capacity electrical connection with an optical connection arrangement which has a highly reliable seal mechanism to ensure that the optical contact faces are sealed at all times and which resists ingress of dirt or water into the optical contact chambers.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIG. 1 is a top view of the two units of a connector according to an exemplary embodiment of the invention, with the units in a fully mated condition;

FIG. 2 is a side view of the receptacle unit;

FIG. 3 is a side view of the plug unit;

DETAILED DESCRIPTION OF THE DRAWINGS

FIGS. 1 to 12 of the drawings illustrate a wet-mateable electro-optical connector according to an exemplary embodiment of the present invention, which is particularly designed for use in subsea environments. It will be understood that the connector of this invention, although particularly intended for use underwater, can also be used in other harsh environments such as splash zones or other volatile or corrosive environments. The illustrated connector connects two electrical circuits and up to four optical circuits. However, it will be understood that this connector may be designed to connect a greater or lesser number of electrical and optical circuits in other embodiments.

The connector is arranged to combine electrical modules similar to those described in U.S. Pat. No. 5,645,442, the contents of which are incorporated herein by reference, with optical modules and a rolling seal arrangement similar to that described in U.S. Pat. No. 6,017,227, the contents of which are also incorporated herein by reference. The arrangement of this invention allows the two different types of contact modules and seal arrangements to be combined in a single, compact connector with increased electrical and optical capacity.

Figure 8:
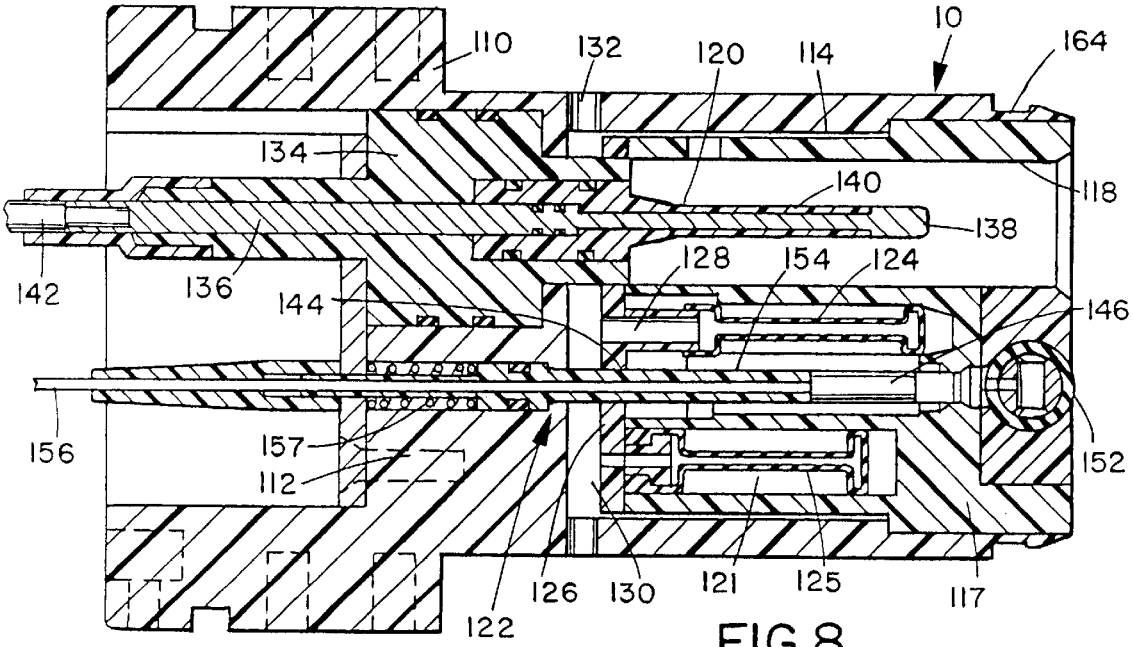
FIG. 8 is an enlarged sectional view taken on line 8—8 of FIG. 4.
Figure 4:
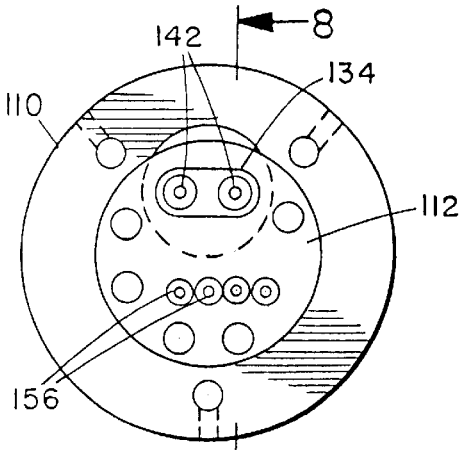
FIG. 4 is a view taken in the direction of arrows 4—4 of FIG. 2.
Figure 9:
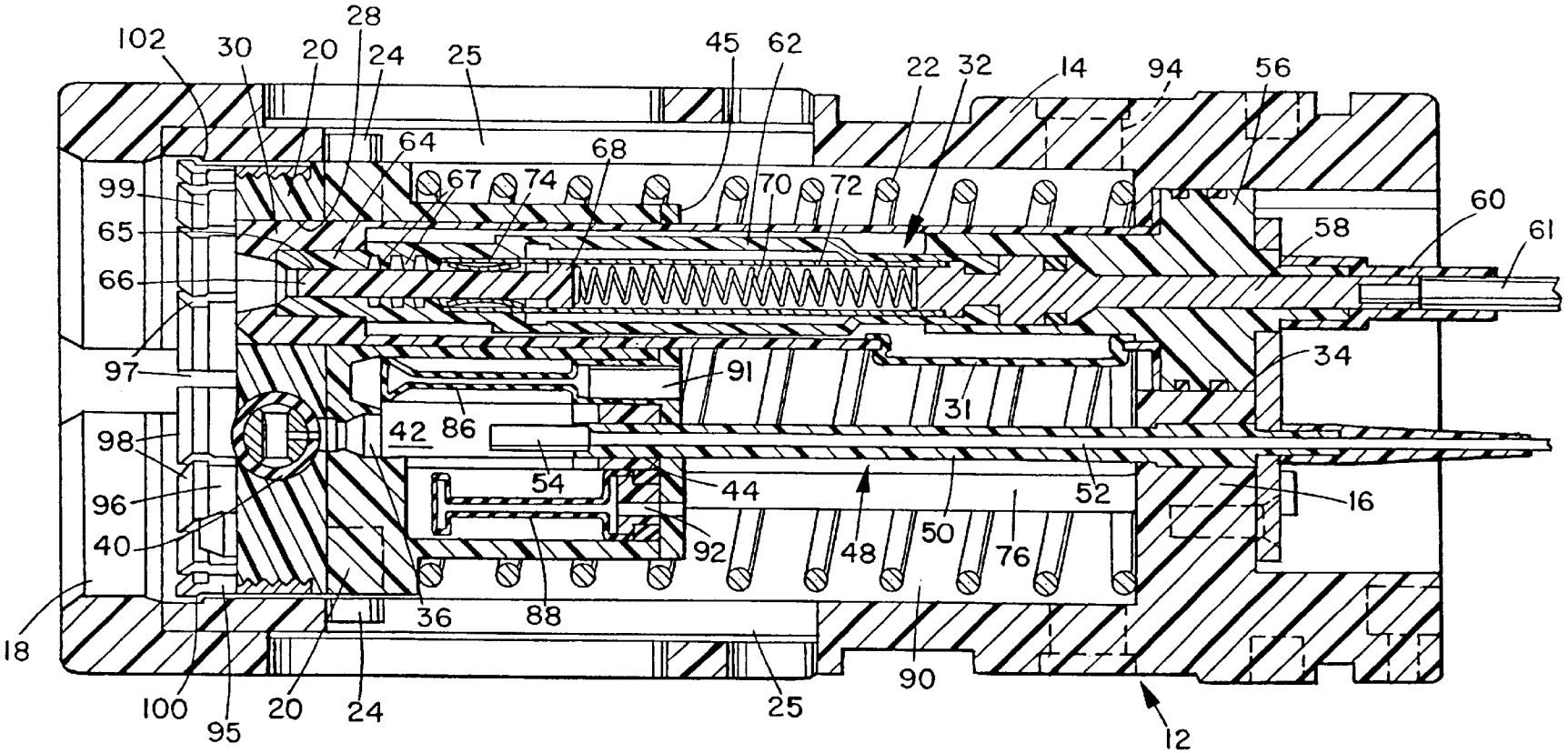
FIG. 9 is an enlarged sectional view taken on line 9—9 of FIG. 7.
Figure 10:
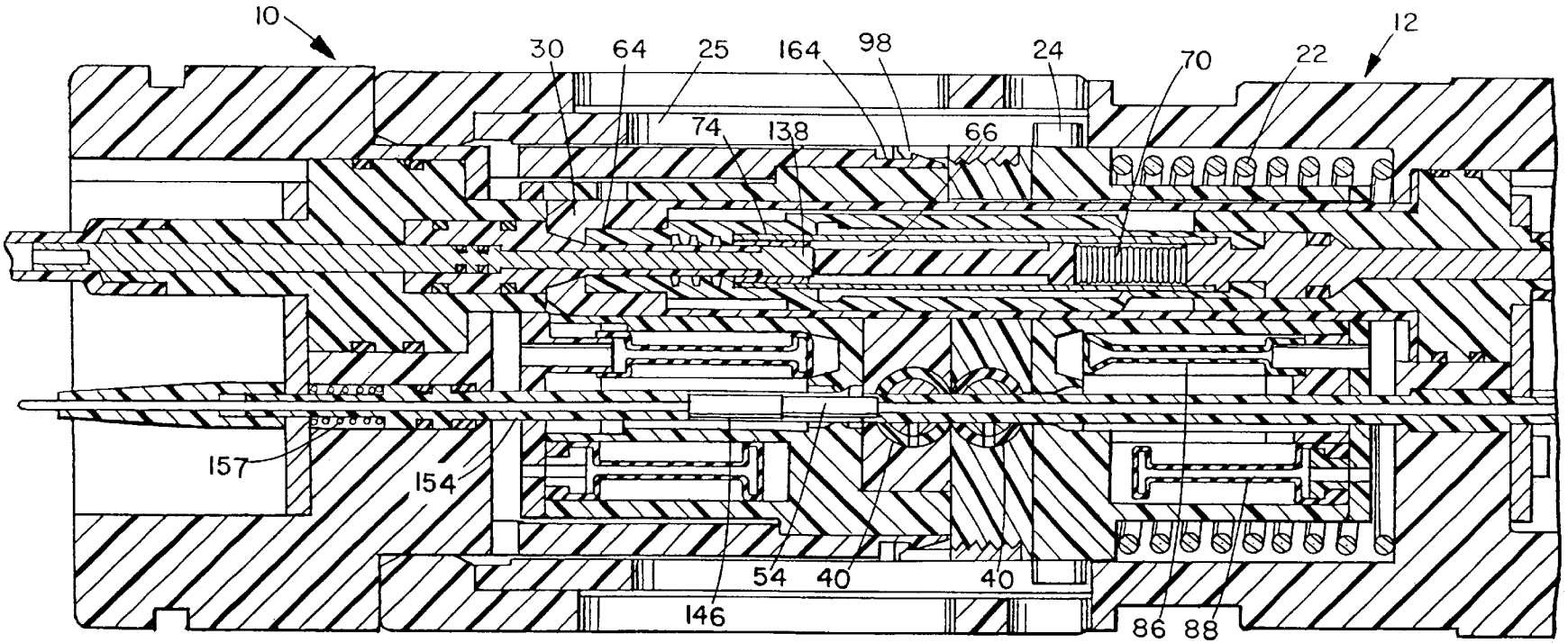
FIG. 10 is a sectional view showing the structures of FIGS. 8 and 9 interconnected.

The connector basically comprises a receptacle unit 10 as illustrated in FIGS. 2 and 8, and a plug unit 12 as illustrated in FIGS. 3 and 9. FIGS. 1 and 10 illustrate the units in a mated condition, while the units are shown separate and unmated in FIGS. 2,3,8 and 9. The plug unit 12 will first be described in detail, with reference to FIGS. 3,6,7 and 9.

The plug unit 12 comprises an outer cylindrical shell 14 of rigid material having a sealed rear end wall 16 and an open forward end 18. A plug manifold 20 is slidably mounted in the shell 14 and is biased by a return spring 22 into the forward position illustrated in FIG. 9. One or more key pins 24 project radially outwardly from manifold 20 and engage into one or more axially extending slots 25 in shell 14 to prevent rotation of the manifold 20 as it moves axially between the forward position of FIG. 9 and the retracted position of FIG. 10.

Figure 6:
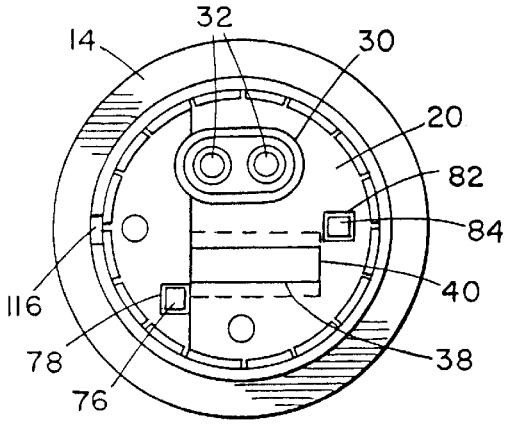
FIG. 6 is a view taken in the direction of arrows 6—6 of FIG. 3.
Figure 7:
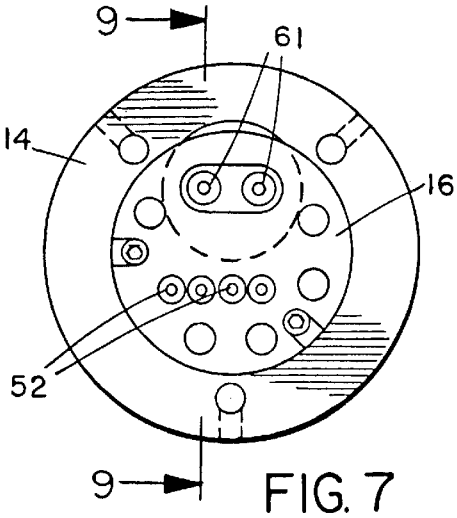
FIG. 7 is a view taken in the direction of arrows 7—7 of FIG. 3.

The manifold 20 has a first through bore 28 in its upper half as viewed in FIGS. 6 and 9, through which an outer housing 30 containing two, side-by-side 25 electrical socket modules 32 is slidably engaged. The housing 30 is secured in a bore 34 in end wall 16 at its rear end. A series of four bores or ports 36 are arranged in a line in the lower half of the manifold, beneath bore 34, with each port terminating at one end in a part-cylindrical seat 38 in which a rolling seal 40 is mounted, and at the other end in an internal optical chamber 42 in the 30 manifold. The rolling seal 40 is illustrated in more detail in FIG. 11. Each port 36 comprises an inlet port into chamber 42, and is aligned with a corresponding port 44 in a rear end wall of chamber 42.

A series of four, side-by-side optical contact modules 48 are mounted in the rear wall 16 of the shell in alignment with the ports 44 and 36, and project 35 forwardly through ports 44 into the chamber 42, which is filled with a dielectric, optically clear fluid or oil. Each optical contact module 48 comprises a rigid tubular housing 50 through which an optical fiber 52 projects, with the fiber being terminated in an alignment ferrule 54 having an optical contact face for making the optical connection. The alignment ferrule 54 is sealed within oil chamber 42 when the units are unmated, as in FIG. 9.

As has been noted above, each of the four optical modules 48 has an alignment ferrule 54 at its inner end which is sealed in an oil-filled chamber 42 in the manifold 20 when in the unmated condition. Inlet ports 36 through the manifold into chamber 42 are sealed by the rolling seal 40 when in the sealed, unmated condition illustrated in FIG. 9. The cylindrical rolling seal 40 has a series of four, parallel through ports 75 extending transverse to the longitudinal axis of seal 40, as well as transverse bleed ports 77 connecting each port 75 to chamber 42 when the seal is in the closed position illustrated in FIG. 9. When the seal is in the closed position, ports 75 extend transverse to ports 36, so that seal 40 closes and seals the ports 36 of chamber 42.

Figure 12:
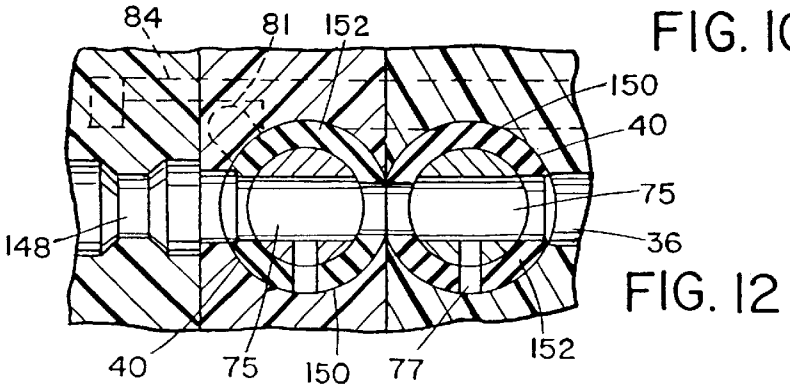
FIG. 12 is an enlarged sectional view similar to a portion of FIG. 10 showing the rolling seals opened.
Figure 11:
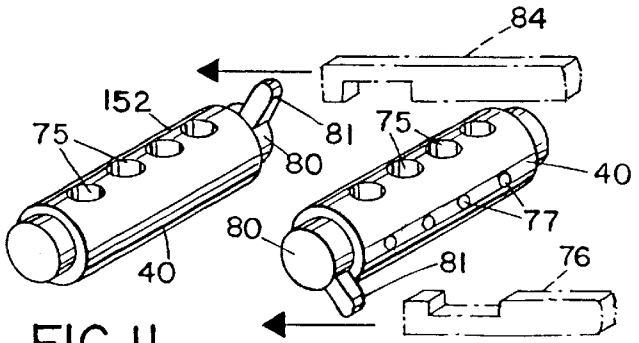
FIG. 11 is a perspective view showing the rolling seal elements.

A first actuator rod 76 for the plug rolling seal, illustrated in dotted outline in FIG. 11, is secured to the rear end wall 16 of the plug unit, and projects forwardly through a rectangular port 78 in the manifold, adjacent an actuator end portion 80 of the rolling seal. The actuator portion has a projecting tab 81 which is engaged by the actuator rod 76 to open the seal when the units are mated, as described in more detail below. The rolling seal, actuator rod, and manner of actuating the seal between the sealed position illustrated in FIG. 9 and the open position of FIG. 12 are all identical to that described in our previous U.S. Pat. No. 6,017,227 referred to above. A second actuator rod 84, also illustrated in FIG. 11, for actuating a corresponding rolling seal 152 in the 25 receptacle unit, is also secured in the rear end wall 16 and projects through square port 82 in the manifold.

The rear end wall 45 of the manifold chamber 42 incorporates a flexible, Morrison-type seal, and flexible bladders 86,88 project forwardly from the sealed end wall 45 into chamber 42. The interior of each bladder communicates with the chamber 90 in shell 14 behind the manifold via passageways 91,92, respectively, through the end wall. Chamber 90 communicates with the external environment via vent ports 94. Thus, bladders 86,88 will be filled with seawater and will act to compensate for changes in pressure between the chamber 42 and the external environment by expanding or contracting as needed. A greater number of pressure compensating bladders may be provided if necessary.

One of the electrical socket modules 32 will now be described in more detail with reference to FIG. 9, with it being understood that the other module is identical to module 32. The outer housing 30 for both modules extends from a base 56 secured in the bore 34 in the rear end wall. The base 56 has through bores through which a pair of conductive elements 58 project, one for each electrical socket module. The outer end of each element 58 is connected to an electrical wire. The base 56 has nipples 60 that extend outward from the base to form an insulative barrier at the wire junction when the conductive element 58 is terminated to an electrical cable 61.

A pair of generally cylindrical bladders 62 made of flexible, elastic, nonconductive material extend forwardly from base 56 within housing 30, each forming an electrical contact chamber within which an electrical socket structure is disposed. The bladder 62 has an enlarged, annular end seal 64 at its forward end through which a passageway 65 extends. The bladder 62 may suitably be made of a natural or synthetic rubber material. The chamber within the bladder 62 is filled with a dielectric fluid of the type described in previous U.S. Pat. No. 5,645,442 referred to above. The outer chamber within housing 30 is also oilfilled and pressure-compensated via flexible compensator 31. A dielectric stopper 66 is slidably mounted in the bladder chamber to project through passageway 65 in the end seal 64. The passageway has internal corrugations or nibs 67 which bear against stopper 66 in the position illustrated in FIG. 9. The stopper has an enlarged flange 68 at its inner end. A spring 70 acts between the inner end of conductive element 58 and the stopper 66, biasing the stopper into the extended position illustrated in FIG. 9 in which the end seal 64 exerts a radially constrictive sealing force on the stopper, forming a fluid and pressure resistant barrier.

A cylindrical conductive tube 72 extends forwardly from conductive element 58 through the chamber in the bladder, terminating in an annular conductive contact band 74 slidably engaged over dielectric stopper 66. The conductive elements are all sealed within the dielectric chamber, with the resilient bladder expanding or contracting to compensate for pressure changes inside and outside the chamber.

A threaded collet sleeve 95 is threadably secured to the front end of the manifold 20 and projects forwardly from the front end face 96 of the manifold. The sleeve 95 is a generally cylindrical member, having a series of inwardly directed slots 97 at its forward end defining spaced, resilient fingers 98. The collet has an inwardly directed, annular rib 99 adjacent its outer end, extending across fingers 98. An outwardly flared or stepped portion 100 of the fingers is located in a groove 102 in the inner wall of shell 12 adjacent the outer end of the shell when the plug unit is in the unmated condition of FIG. 9.

Figure 5:
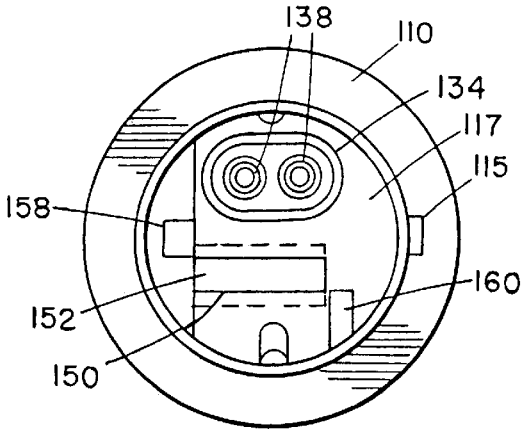
FIG. 5 is a view taken in the direction of arrows 5—5 of FIG. 2.

The mating receptacle unit 10 is best illustrated in FIGS. 2, 4,5 and 8. Receptacle unit 10 also has a rigid outer shell 110 having a terminal or rear end wall 112 and a cylindrical bore 114 projecting inwardly from its forward end. A conventional alignment key 115 projects radially outwardly from the shell 110, as best illustrated in FIG. 5. When the plug and receptacle units are secured together, key 115 will engage in an axial alignment keyway 116 projecting inwardly from the outer end face of the plug shell, best illustrated in FIG. 6. This ensures proper alignment of the electrical and optical contacts in the plug and receptacle units as the units are mated together.

A receptacle manifold block 117, also of rigid material, is secured in the bore 114 via suitable retaining screws. Manifold block 117 has a first bore 118 of generally oval cross-section forming an electrical contact chamber for receiving two, side-by-side electrical pin or probe modules 120, located in the upper half of the block. The bore or chamber 118 is open at its forward end. A sealed internal chamber 121 for the optical modules 122 is located in the lower half of the manifold block 116. As in the plug unit manifold, chamber 121 is filled with an optically clear dielectric fluid, and contains two or more flexible bladders 124,125 which project inwardly from the rear end wall 126 of the chamber, and which communicate with the external environment via passageways 128 in the end wall, chamber 130 behind the manifold, and vent ports 132.

The electrical probe modules 120 are each mounted in a single, rigid dielectric base member 134 secured in end wall 112, as best illustrated in FIG. 8. The base member 134 has two through bores through which the respective electrical probe modules project. Each probe module comprises a conductive probe shaft 136 extending through the respective bore in the base member forwardly into bore 118 and terminating in a conductive tip 138 of generally convex shape. Probe or shaft 136 has an outer protective shell 140 of dielectric material which extends from the base member 134 and terminates short of the conductive tip 138. The rear end of each shaft 136 is suitably attached to a conductive wire at the end of an electrical cable 142 in a conventional manner.

A series of four, side-by-side optical modules 122 are mounted in corresponding bores in the rear end wall 112 and project forwardly through aligned openings 144 in the rear end wall 126 of the optical chamber, terminating in alignment ferrules 146 within the chamber 121. The front end wall of the chamber has a series of ports 148 aligned with openings 144 and ferrules 146, with the ports 148 terminating in a semi-cylindrical seat 150 in which a rolling seal 152 is located. The rolling seal 152 is identical to the rolling seal 40 in the plug unit, and like reference numerals have been used for like parts as appropriate.

Each optical module 122 comprises a tubular housing 154 through which an optical fiber 156 extends and terminates to the respective alignment ferrule 146. The tubular housing 154 is biased outwardly by spring 157, which acts to urge the optical faces into contact when the plug and receptacle units are mated.

As best illustrated in FIG. 5, the manifold block 117 has a first square or rectangular bore 158 for receiving the actuator rod 84. Bore 158 coincides with an actuator chamber in which the actuating end portion of the rolling seal 152 is located. Block 117 also has a rectangular opening 160 for receiving the actuator rod 76 of the plug unit when the two units are mated as in FIG. 10.

The shell 110 of the receptacle unit has a rear, larger diameter portion and a forward, reduced diameter portion 162 for slidable engagement in the open forward end of the plug shell 14. The forward portion of the shell has an annular groove 164 for snap engagement with the rib 99 in the locking collet of the plug unit, as will be described in more detail below.

The mating sequence of the plug and receptacle units will now be described in more detail, with reference to FIGS. 8 to 12. As noted above, the plug and receptacle units are shown in their unmated condition in FIGS. 9 and 8, respectively, in which each of the rolling seals is in a closed, sealed position, and the dielectric stopper 66 is located in sealing engagement with the end seal 64 of each of the plug electrical socket modules. As the two units are brought together with their front ends facing one another, the forward end portion 162 of the receptacle shell starts to enter the bore at the front end of the plug shell, assuming that the key 115 is properly lined up with keyway 116. As the portion 162 continues to travel into the shell 14, the locking collet rib 99 will snap into groove 164.

When the front end of the shell 110 and manifold 117 contacts the front face 96 of the plug manifold, the plug manifold will be pushed inwardly, compressing spring 22. At the same time, the locking collet will be forced out of groove 102 and into the smaller diameter portion of the plug shell behind groove 102 locking the rib 99 in groove 164 and securing the units together. The projecting portions of the rolling seals will engage, and be compressed in a squeegee like fashion. Simultaneously, as the plug manifold is pushed inwardly, the two fixed actuator rods 76 and 84 will project out of the front face of the manifold and enter the aligned ports in the receptacle manifold block 117. The rods will engage with the actuator tabs on the end portions of the respective rolling seals, rolling them from the closed position of FIGS. 8 and 9 into the open position of FIG. 10, in which the through ports 75 are each aligned with the manifold ports 36 and 148. The rolling seal actuation is best illustrated in FIGS. 11 and 12. As the plug manifold is urged rearwardly, the optical alignment ferrules 54 will move out of the manifold 20, through the ports 36, through the aligned ports 75 in the rolling seals, and finally through the ports 148 into the chamber 121 in the receptacle manifold block. The end faces of ferrules 54 will engage the end faces of the receptacle ferrules 146 to provide for optical communication between fibers 52 and 156, as illustrated in FIG. 10.

At the same time as the rolling seals are being actuated by the respective actuator rods, the tips 138 of the electrical probes will each enter the aligned passageway in the respective end seal 64, contacting the concave outer end face of the respective stopper 66. Continued movement of the receptacle shell into the plug shell will cause the electrical probes to push the stoppers 66 inwardly, compressing springs 70, until the conductive tip 138 is in electrical contact with contact band 74, establishing electrical connection between the plug and receptacle units. At the same time, the dielectric sleeve 140 surrounding the probe shaft will replace the stopper 66 in the end seal 64, with the end seal constricting against sleeve 140 to form a fluid and pressure resistant seal of the bladder chamber containing the contacts. The nibs 67 act as wipers to remove contaminants as the probe enters the bladder chamber, as described in more detail in U.S. Pat. No. 5,645,442 referred to above. Any standard coupling device may be used to retain the connected plug and receptacle units in the mated condition of FIG. 10, as will be understood by those skilled in the field.

When the units are separated or demated, the end faces of the plug and receptacle manifolds will initially be held in face-to-face sealing engagement by the engagement of the collet rib 99 in groove 164, until the plug manifold is returned outwardly to a position in which rib 99 is aligned with the groove 102 in the plug shell. As the receptacle unit is retracted, spring 22 will act to move the plug manifold 20 outwardly. The receptacle seal actuator rod 84 will move out of the receptacle manifold, simultaneously rotating the seal 152 back into the closed position as the optical ferrules 54 are retracted from the receptacle manifold back into the plug manifold. The plug seal actuator rod 76 also moves out of the receptacle manifold and is retracted back into the plug manifold, simultaneously rotating seal 40 back into the closed and sealed position as soon as the optical contact ferrules 54 are retracted back into the optical chamber 42. At the same time, the electrical probes 120 are also retracted from the socket module 32, while spring 70 urges stopper 66 back into position in the end seal 64.

Figure 14:
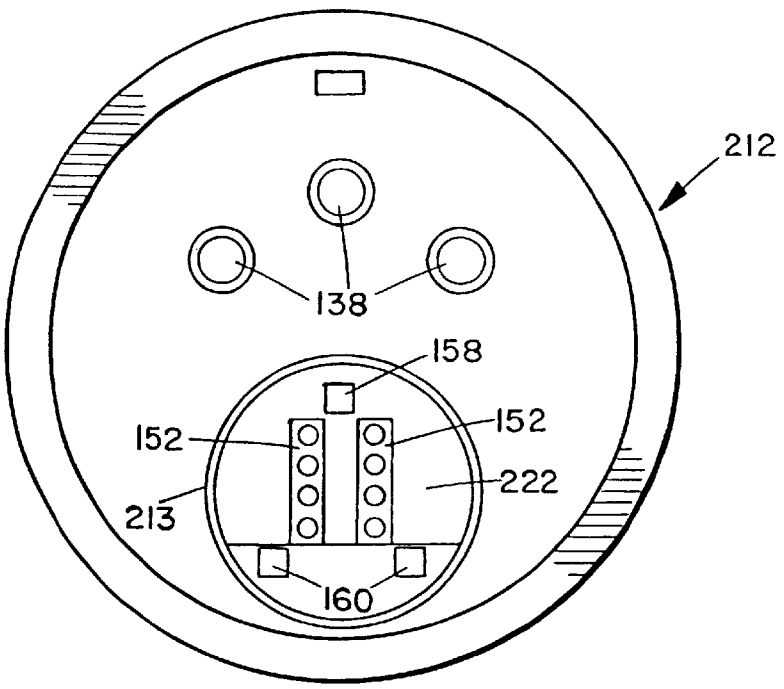
FIG. 14 is an end view similar to FIG. 6, illustrating a receptacle unit for releasable mating engagement with the plug unit of FIG. 13.
Figure 13:
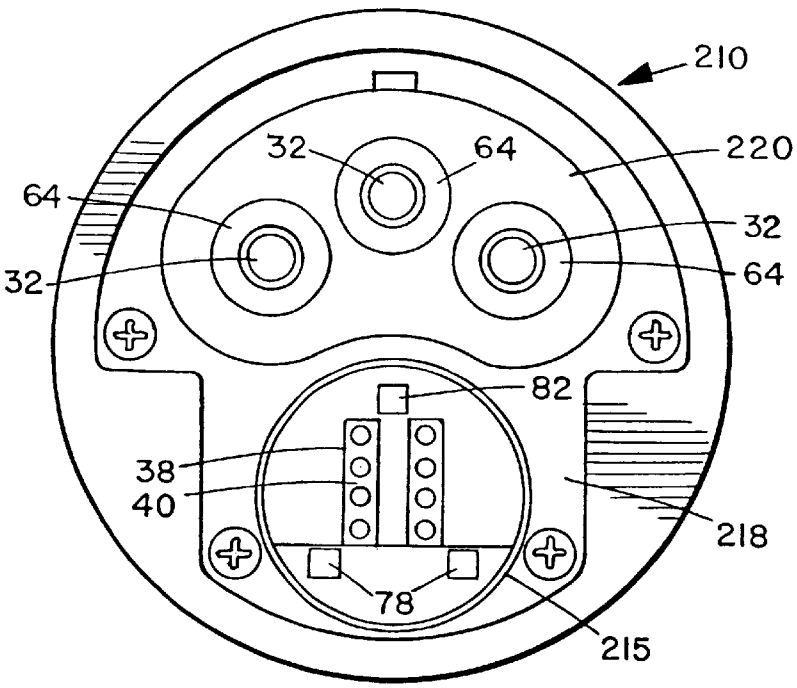
FIG. 13 is an end view similar to FIG. 5 illustrating a modified plug unit according to another embodiment of the invention.

FIGS. 13 and 14 are end views similar to FIGS. 6 and 5, respectively, but illustrating modified plug and receptacle units 210,212, respectively, which each have three electrical modules and eight optical contact modules. The receptacle unit 212 of FIG. 14 is similar to that of FIGS. 5 and 8, and like reference numerals have been used as appropriate. However, the unit has eight optical contact modules arranged in two groups of four, each sealed by a separate cylindrical rolling seal 152, and the optical contact modules are housed in a cylindrical housing 213 projecting forwardly from the rear end wall 214 of the receptacle shell.

The plug unit 210 of FIG. 13 differs from plug unit 12 of FIGS. 6 and 9 because the electrical contact modules do not engage in a slidably mounted, spring-biased plug manifold at the end of the plug shell, as in the previous embodiment. Instead, the electrical contact or socket modules are housed completely separately from the optical modules. However, the modules themselves are otherwise identical to the previous embodiment, and like reference numerals have been used as appropriate. Thus, in the embodiment of FIG. 13, rather than having a single end manifold 20 of diameter substantially equal to the diameter of the bore in the plug shell 14, a smaller diameter cylindrical housing 215 projects forwardly from the shell rear end wall 216 for housing the optical modules and end seal arrangements. An optical contact manifold 218 is slidably mounted at the outer end of housing 215, and is biased by a spring (not illustrated) into the fully extended position, as in the previous embodiment. Each of the optical contact modules in the two sets of four modules is aligned with a respective port in the manifold 218 which terminates in a respective, part-cylindrical seat 38 for a respective rolling seal member 40. It will be understood that the rolling seal members and actuators are identical to those of the previous embodiment. The electrical socket modules 32 extend from the rear wall of the plug shell into a fixed end plug or member 220.

The mating sequence of the plug and receptacle units 210,212 is similar to that of the previous embodiment. As the two units are brought together, the forward end of the housing 213 in the receptacle unit will start to enter housing 215 in the plug unit. The manifold 218 will have a locking collet similar to locking collet 95 of the previous embodiment, which has a rib for engagement in a groove in housing 213, equivalent to groove 164 in the respectacle shell of the previous embodiment. The manifold 218 is then pushed rearwardly by the front end wall 22 of housing 213, while the actuators rotate the rolling seals into the open position, and the optical contacts move into engagement, exactly as in the previous embodiment. At the same time, the tips 138 of the electrical probes enter the aligned passageways in the respective end seals 64, pushing back the stoppers and moving into electrical contact with the sockets.

This invention therefore combines two different types of seal arrangement in a single connector assembly, with an effective sealing mechanism for the optical circuits using a rolling seal arrangement, and a simpler sealing mechanism on the electrical side which is adequate for the electrical circuits and allows higher voltage and current capacity. This provides a unique and useful connector which can be used for connecting almost any combination of optical and electrical circuits.

Although an exemplary embodiment of the invention has been described above by way of example only, it will be understood by those skilled in the field that modifications may be made to the disclosed embodiment without departing from the scope of the invention, which is defined by the appended claims.

We claim:

1. An electro-optical connector, comprising:

a receptacle unit and a plug unit releasably securable to the receptacle unit in a mated condition of the units;

the units each having a rear end, a front end, and at least two separate chambers extending side-by-side inwardly from the front end, one of said chambers comprising an optical contact chamber and the other of said chambers comprising an electrical contact chamber;

at least one optical contact element mounted in said optical contact chamber and at least one electrical contact element mounted in said electrical contact chamber;

each of said optical contact chambers having a front end wall having a recessed seat communicating with the respective optical contact chamber, and a seal member movably mounted in the seat, the seal member having at least one through bore and being movable in a non-axial direction relative to the respective unit between a first, closed position in which the through bore is offset from the optical contact chamber and the front end wall of the optical contact chamber is sealed, and a second, open position in which the seal through bore is aligned with the optical contact chamber;

the optical contact element in the optical contact chamber of the plug unit extending through the aligned through bores into the optical contact chamber of the receptacle unit when the units are mated together and the seal members are in the open position to contact the optical contact element in the optical contact chamber of the receptacle unit;

a first one of the electrical contact chambers having a front end wall having a sealable opening, an annular seal member mounted in the sealable opening, and a resiliently biased stopper movably disposed within the annular seal member and in sealing engagement with the annular seal member when the units are not mated, the electrical contact element in the electrical contact chamber comprising an electrical socket; and the electrical contact element in the other electrical contact chamber comprising a conductive probe adapted for insertion through the sealable opening in the first electrical contact chamber to sealably engage the annular seal member and engage the electrical contact element in the first electrical contact chamber when the units are mated together.

2. The connector as claimed in claim 1, wherein the electrical socket is located in the plug unit and the conductive probe is located in the receptacle unit, the electrical contact chamber in the receptacle unit having an open forward end.

3. The connector as claimed in claim 1, wherein each unit has a plurality of electrical contact elements and a plurality of optical contact elements.

4. The connector as claimed in claim 3, wherein the unit containing the electrical sockets has a plurality of electrical contact chambers, each chamber containing a single electrical socket.

5. The connector as claimed in claim 4, wherein the unit containing the conductive probes has a single electrical contact chamber containing the conductive probes, the chamber having an open forward end.

6. The connector as claimed in claim 1, wherein the plug unit comprises a hollow shell having a plug manifold slidably mounted in the shell for movement between a retracted position within the shell and an extended position adjacent the front end of the shell, and a spring mounted in the shell behind the manifold for biasing the manifold into the extended position, the optical contact chamber being located in said plug manifold.

7. The connector as claimed in claim 6, wherein the plug manifold has a front end face for engagement with the front end of the receptacle unit as the units are secured together, the front end of the receptacle unit extending into the shell of the plug unit to urge the plug manifold into the retracted position when the units are mated.

8. The connector as claimed in claim 6, wherein the plug unit shell has a first cylindrical housing of smaller diameter than the shell, the plug manifold being slidably mounted in the housing and the optical contact modules extending from the rear end of the plug unit through said housing and into said optical contact chamber, the electrical contact chamber being located in said shell outside said cylindrical housing.

9. The connector as claimed in claim 8, wherein the receptacle unit comprises a hollow shell having a second cylindrical housing of smaller diameter than said shell projecting from the rear end of the receptacle unit in alignment with the cylindrical housing in the plug unit, the optical contact chamber being located in said second cylindrical housing, and said second cylindrical housing having a front end face for engaging the front end face of said plug manifold when the units are secured together to urge the plug manifold into the retracted position.

10. The connector as claimed in claim 6, wherein the plug manifold has a first portion and a second portion, the optical contact chamber being located in the first portion of the plug manifold, and the second portion of the plug manifold having a through bore, and at least one electrical contact module extending from the rear end of the plug unit into the through bore, the electrical contact chamber and electrical contact element being located in said electrical contact module.

11. The connector as claimed in claim 10, wherein the receptacle unit comprises a shell and a receptacle manifold secured in the front end of the shell, the receptacle manifold having a front end face engaging the front end face of the plug manifold when the units are mated, the receptacle manifold having first and second portions aligned with the first and second portions of the plug manifold when the units are mated, the first portion of the receptacle manifold containing the optical contact chamber and the second portion of the receptacle manifold containing the electrical contact chamber.

12. The connector as claimed in claim 11, wherein the first and second portions of each manifold comprise opposite halves of the respective manifold.

13. The connector as claimed in claim 11, wherein the conductive probe is located in the receptacle unit and the electrical socket is located in the plug unit, the electrical contact chamber in the receptacle manifold comprising a bore having an open forward end, and the electrical contact module of the plug unit extending out of the plug manifold and into the bore for mating engagement with the conductive probe when the units are mated.

14. The connector as claimed in claim 11, wherein the optical contact chambers each contain a plurality of optical contact elements for optical contact with respective optical contact elements in the other optical contact chamber, and the optical contact elements in each chamber are arranged in a line.

15. The connector as claimed in claim 14, wherein the electrical contact chamber in the receptacle unit contains a plurality of conductive probes, and the plug unit contains a plurality of electrical contact modules each containing an electrical socket for contact with respective conductive probes.

16. The connector as claimed in claim 1, wherein each seal member is cylindrical and has a central longitudinal axis, the seal members being rotatable about said central longitudinal axis between the open and closed positions, and the seal through bores extend transversely through the central longitudinal axis of each seal member.

17. The connector as claimed in claim 16, wherein each seat comprises a part-cylindrical recess and each seal member has a protruding portion projecting out of said recess and outwardly from the front end wall of the optical contact chamber.

* * * * *